United States Patent [19]

Brasuell et al.

[11] Patent Number: 4,678,213

[45] Date of Patent: Jul. 7, 1987

[54] LOCKING APPARATUS

[76] Inventors: Larry R. Brasuell, 1798 E. Nees, Fresno, Calif. 93710; Clayton E. Olson, 2666 W. San Jose, Fresno, Calif. 93711

[21] Appl. No.: 700,028

[22] Filed: Feb. 11, 1985

[51] Int. Cl.[4] ..... E05C 9/02

[52] U.S. Cl. ..... 292/37; 292/DIG. 15; 292/170

[58] Field of Search ..... 292/37, 130, 170, 179, 292/DIG. 15, 144

[56] References Cited

U.S. PATENT DOCUMENTS

| | | | |
|---|---|---|---|
| 849,932 | 4/1907 | Tatum . | |
| 1,020,454 | 3/1912 | Seidenbecker . | |
| 1,518,613 | 12/1924 | Teeter . | |
| 1,654,221 | 12/1927 | Kline . | |
| 1,946,384 | 2/1934 | Brail et al. | 292/37 X |
| 2,479,256 | 8/1949 | Radcliffe | 292/170 X |
| 2,804,329 | 8/1957 | Landis | 292/170 |
| 3,157,418 | 11/1964 | Duncan | 292/DIG. 15 X |
| 3,792,884 | 2/1974 | Tutikawa | 292/37 |
| 3,984,136 | 10/1976 | Bills | 292/182 |
| 4,050,723 | 9/1977 | Papadatos | 292/164 |

FOREIGN PATENT DOCUMENTS

| | | | |
|---|---|---|---|
| 2810058 | 9/1978 | Fed. Rep. of Germany | 292/37 |

*Primary Examiner*—Richard E. Moore
*Attorney, Agent, or Firm*—Worrel & Worrel

[57] ABSTRACT

An apparatus for locking a door or window providing a frame adapted for attachment on the door; a plurality of locking elements borne by the frame and movable between an unlocked attitude and a locked attitude in engagement with a portion of the doorway frame; and an actuating assembly operable to move the locking elements substantially simultaneously between a locked attitude and an unlocked attitude.

4 Claims, 7 Drawing Figures

LOCKING APPARATUS

BACKGROUND OF THE INVENTION

1. Field of the Invention

The present invention relates to a locking apparatus and more particularly to such an apparatus which is adapted for use in securing doors, windows and the like in closed attitudes.

2. Description of the Prior Art.

The use of locks and security mechanisms on doors and windows has long been known. Further, myriad attempts have previously been made to provide locking devices, such as deadbolts, latches, chains, and the like, adapted to be mounted on doors which serve as adjuncts to preexisting locking mechanisms provided on doors or door knobs.

Many such attempts have yielded devices which are deficient in one or more regards. For instance, some devices are adapted to be attached on or near the side edge portion of the door nearest the knob or other release mechanism. Auxillary locking devices deployed in such attitudes are often capable of being circumvented or overcome by the use of prying devices or through the application of force to the door. Moreover, it is well known that the edge of the door farthest from the hinges is the portion most susceptible to yielding upon the application of force.

Therefore, it has long been known that it would be desirable to have a device adapted for use in conjunction with a door, window, or the like, alone or in combination with other locking devices, to provide security against unauthorized opening of such a door, window or the like.

OBJECTS AND SUMMARY OF THE INVENTION

Therefore, it is an object of the present invention to provide an improved locking apparatus.

Another object is to provide such an apparatus which is adapted for use in conjunction with doors, windows and the like in myriad operative environments.

Another object is to provide such an apparatus which is compact and is adapted to be installed securely and easily on a virtually unlimited variety of doors.

Another object is to provide such an apparatus which is adapted to be constructed as an integral part of a door.

Another object is to provide such an apparatus which is capable of economical construction for sale at a nominal price.

Another object is to provide such an apparatus which is exceedingly durable for use over a long operational life.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
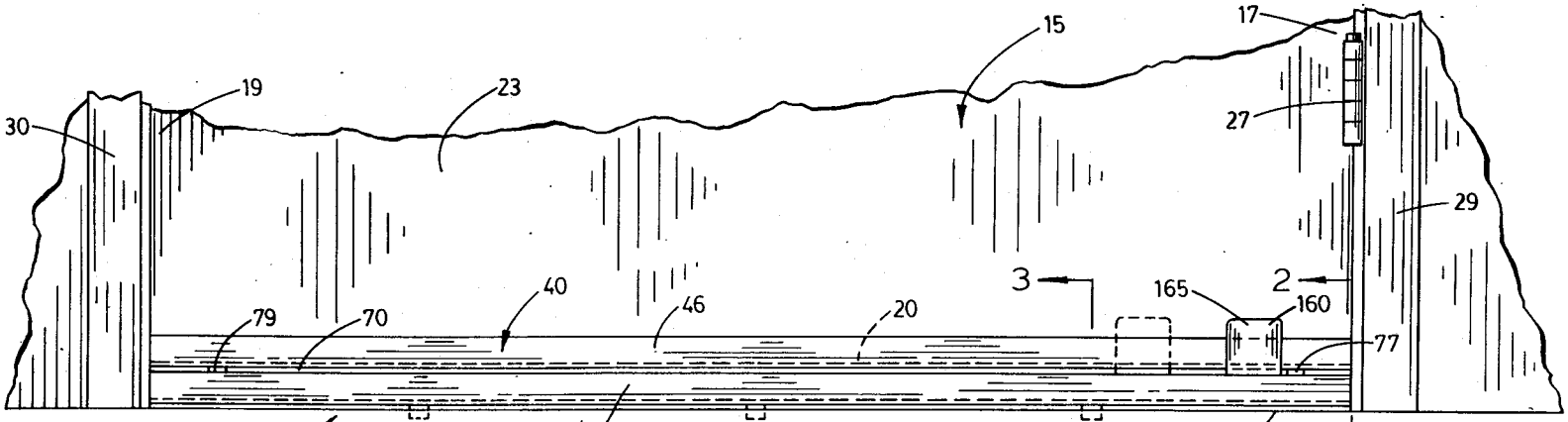
FIG. 1 is a side elevation of the apparatus of the present invention shown deployed in a locked attitude in a typical operative environment, mounted on a fragmentarily depicted door.

Referring more particularly to the drawings, the apparatus of the present invention is designated generally by the numeral 10 in FIG. 1. As shown therein, the apparatus 10 is depicted operatively deployed in a typical operational environment installed upon a door 15. The door is depicted as being of typical, conventional construction and is shown, fragmentarily, providing a predetermined first vertical edge portion 17 and an opposite, second vertical edge portion 19 spaced a predetermined distance or width from the first vertical edge portion 17. The door further provides a lower edge portion 20 extending substantially perpendicularly between the first vertical edge portion 17 and second vertical edge portion 19.

Figure 2:
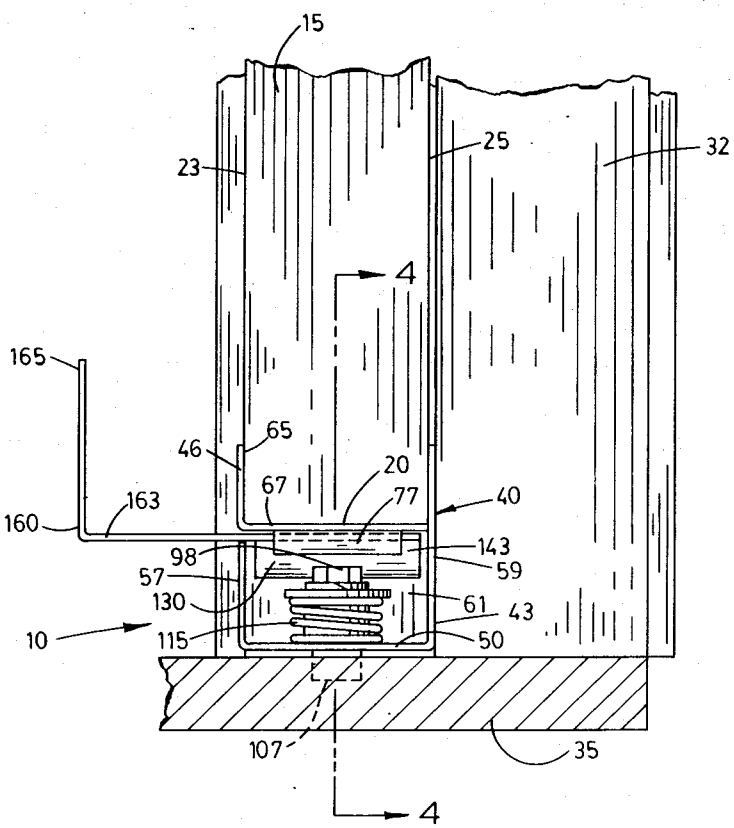
FIG. 2 is a somewhat enlarged transverse section taken on line 2—2 in FIG. 1.

As can best be seen by reference to FIG. 2, the door has a predetermined inner surface 23 and an opposite, outer surface 25, both of which are substantially flat and disposed in substantially parallel planes. As can also best be seen by reference to FIG. 2, the bottom edge portion 20 of the door 15 is substantially flat and is disposed in a plane substantially normal to those in which lie the inner surface 23 and outer surface 25.

The door 15 is typically mounted along its first vertical edge portion 17 by a plurality of hinges 27, one of which is shown in FIG. 1, to a doorway frame having a doorjamb 29 and an opposite doorjamb 30 providing a stop portion 32 spaced from the first jamb 29 a width slightly greater than that of the door 15. Both the first jamb 29 and second jamb 30 are disposed in substantially vertical attitudes relative to a threshold 35. As shown in FIG. 1, the door 15 is depicted as being mounted for pivotal movement about an axis coaxial with the longitudinal axis of the hinge 27, whereby, in order to dispose the door in an opened attitude, it is pivoted about the hinge 27 away from engagement with the stop 32. The door is provided with a knob or the like (not shown). It is understood that the door on which the apparatus 10 is shown mounted is typical in its construction and is not to be considered limiting.

Figure 3:
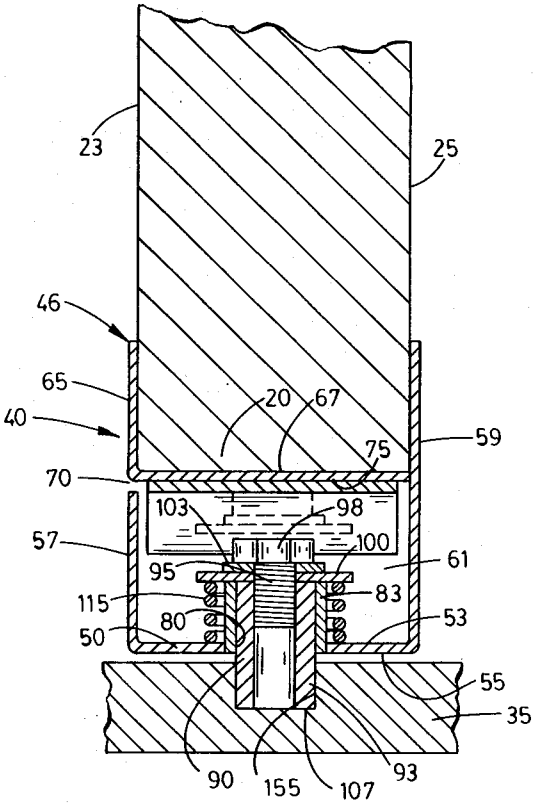
FIG. 3 is a somewhat enlarged transverse section taken on line 3—3 in FIG. 1, with a locking element portion shown in an unlocked attitude in phantom lines.

As can best be seen in FIGS. 1, 2 and 3, the apparatus 10 generally provides a housing or frame 40. The frame provides a first or lower portion 43 and a second or upper portion 46 secured to the lower portion 43.

The lower portion has an elongated, substantially flat base 50 having an upper surface 53 and an opposite, substantially flat lower surface 55. A first, elongated, substantially flat upright portion 57 extends substantially perpendicularly from the base 50. A second, elongated, substantially flat upright portion 59 extends substantially perpendicularly from the base 50 in spaced relation to the first upright portion 57 and is separated from the first upright portion by a distance slightly greater than the thickness of the door 15 to which the device 10 is to be secured. As can best be seen by reference to FIGS. 2 and 3, the second upright 59 extends from the base 50 a distance greater than does the first upright 57. The base 50 and upright portions 57 and 59 define a channel 61 of predetermined dimensions bounded thereby.

The upper portion 46 has an elongated, substantially flat upright portion 65 having a length preferably, although not necessarily, approximately equal to the width of the door 15. A substantially flat, elongated base portion 67 extends substantially perpendicularly from the upright portion 65 and is secured as by welding or the like on the second upright portion 59 of the lower portion 43 of the frame 40. The base 67 of the upper portion 46 is disposed substantially perpendicularly to the second upright portion 59. Thus, as can best be seen by reference to FIGS. 2 and 3, the upright portion 65 and base portion 67 of the upper portion 46 and the second upright portion 59 of the lower portion 43 define an elongated channel dimensioned substantially closely to be received about the lower edge portion 20 of the door 15 when the apparatus 10 is deployed in an operative attitude. The frame 40 can be installed on the lower edge portion 20 of the door 15 and secured thereto as by bolts, screws, glue, or any other suitable fastening means.

As can best be seen by reference to FIGS. 1 and 3, the point of intersection of the upright portion 65 and the base portion 67 of the upper portion 46 is spaced upwardly of the uppermost edge of the first upright portion 57 of the lower portion 43 to define an elongated slot 70 therebetween communicating with the channel 61.

Figure 4:
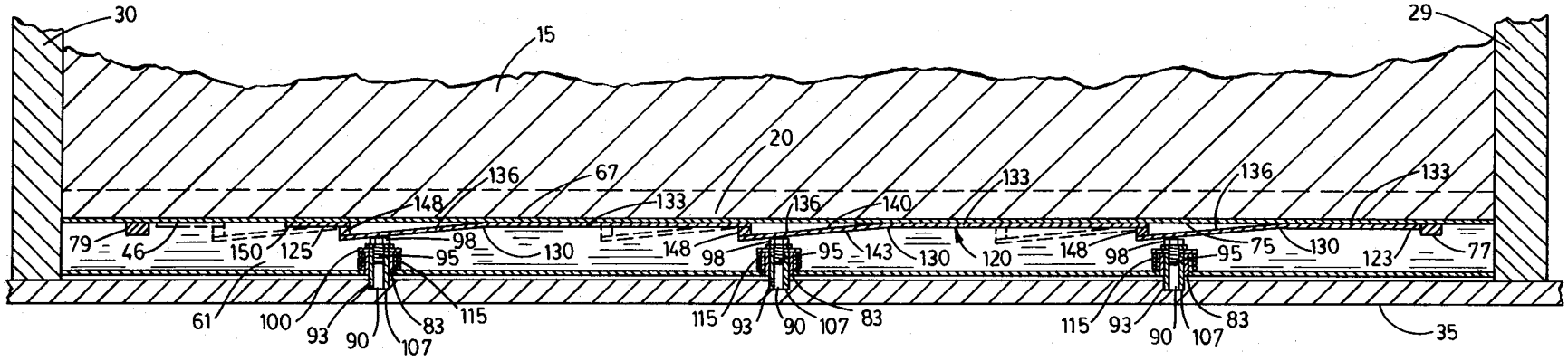
FIG. 4 is a longitudinal section taken on line 4—4 in FIG. 2, with a portion of the apparatus shown deployed in a second attitude in phantom lines.

As can best be seen in FIG. 4, the base portion 67 of the upper portion 46 has a substantially flat undersurface 75. A first detent 77 and a second detent 79 are secured on the undersurface 75 and are spaced remotely from each other a predetermined distance.

As can best be seen by reference to FIGS. 3 and 4, the base portion 50 of the lower portion 43 provides three apertures 80 therethrough. The apertures are spaced a predetermined distance from each other and are spaced inwardly of the opposite end portions of the frame 40. Preferably, although not necessarily, each aperture is circular in configuration. The base portion 50 further mounts three guide cylinders 83 individually disposed in an axially upright attitude circumscribing an aperture 80. Each guide cylinder 83 is of predetermined dimensions and extends incompletely toward the undersurface 75 of the base portion 67 of the upper portion 46.

Each guide cylinder 83 supports a locking element 90 for slidable movement therein. Each locking element has a substantially cylindrical body 93 bearing a bolt 95 screw-threadably secured thereto. The bolt provides a head portion 98 disposed externally of the cylindrical body 93. Biased between the head 98 of the bolt 95 and the body 93 are an annular flange piece 100 and an annular washer 103. The flange 100 has a diameter greater than that of the body 93. The body is dimensioned for substantially close-fitting, slidable movement axially within the guide cylinder 93. As can best be seen by reference to FIGS. 3 and 4, the body 93 has a length greater than that of the guide cylinder 83 in which it is mounted, whereby upon complete slidable movement of the body downwardly within the guide cylinder, a predetermined lower end portion 107 of the body 93 extends externally of the frame 40 a predetermined distance in a first or locked attitude. The body 93 is further dimensioned to permit substantially complete retraction thereof to dispose the body in a second or retracted attitude wherein the lower end portion 107 is substantially completely internal of the guide cylinder 83.

A helical compression spring 115 is loosely fitted about each guide cylinder 83 and is dimensioned for compressible engagement thereof by the flange 100.

The device 10 further provides an actuating assembly 120 having a first end portion 123 and a second end portion 125 spaced therefrom a distance less than the distance separating the detents 77 and 79. The actuating assembly 120 is slidably movable between a first position wherein the first end portion 123 is in engagement with the detent 77 and a second position wherein the second end portion 125 is in engagement with the detent 79.

The actuating assembly 120 provides a plurality of actuating members 130 equal in number to the number of locking elements 90 which, in the preferred embodiment, is three. Each actuating member 130 is of dimensions and configurations substantially similar to that of the other actuating members. Each actuating member provides a first or flat portion 133 of predetermined length and a second or oblique portion 136 extending from the flat portion 133 and deflected obliquely downwardly relative to the flat portion 133. Each actuating member 130 provides an upper surface 140 and an opposite, lower surface 143.

The actuating members 130 are rigidly serially interconnected in end-to-end relation with the oblique portions 136 substantially equidistantly spaced from each other. The endmost portion of each oblique portion is disposed in overlapping relation to the endmost portion of the flat portion 133 of the next succeeding actuating member 130 and is rigidly interconnected thereto and spaced therefrom by a spacer or block 148 secured thereto as by welding or the like. Alternatively, the actuating members and blocks can be cast as a single piece.

A substantially flat detent engagement member or tongue 150 is rigidly secured to the oblique portion 136 of the actuating member 130 on the second end portion 125 of the actuating assembly 120. The tongue 150 is interconnected to the oblique portion 136 by a block 148 secured to the oblique portion and tongue by welding or other suitable means.

The flat portions 133 of the actuating members 130 and the tongue 150 are disposed in a substantially common plane. As can best be seen upon reference to FIG. 3, the actuating assembly 120 has a predetermined width slightly less than the distance separating the first upright portion 57 and second upright portion 59 of the lower portion 43 of the frame 40 to permit slidable movement of the actuating assembly 120 between the first and second positions substantially without lateral restriction.

As can best be seen upon reference to FIGS. 2, 3 and 4, the actuating assembly 120 is urged upwardly by engagement of the lower surfaces 143 of the actuating members 130 by the head portions 98 of the bolts 95. The helical spring 115 exerts upward pressure against the annular flange piece 100 of each locking element 90 to cause the head portion 98 of each bolt 95 to remain in engagement with the lower surface 143 of each corresponding actuating member 130, regardless of the position in which the actuating assembly 120 is deployed. The upper surfaces 140 of the actuating members 130 are thereby maintained in a substantially biased relation against the undersurface 75 of the base portion 67 of the upper portion 46 of the frame 40. Preferably, a suitable lubricant is provided between the undersurface 75 and upper surface 140, as well as between the lower surface 143 and the heads 98 of the bolts 95 to permit minimally frictional sliding movement of the actuating assembly 120 between the first and second positions.

To accommodate the deployment of the apparatus 10 on a conventional door 15, a plurality of bores 155 are provided in the threshold in spaced relation from each other. Preferably, the holes are spaced and dimensioned for slidable insertion of the lower end portions 107 of the locking elements 90 therein when the door is closed and the apparatus is deployed in a locked attitude.

As can best be seen in FIGS. 1 and 2, a handle member 160 is provided having a first portion 163 rigidly secured as by welding or the like on the lower surface 143 of one of the actuating members 130. The first portion is substantially flat and extends externally of the frame 40 through the slot 70. An upwardly extending portion 165 extends substantially perpendicularly upwardly from the first portion and is disposed completely externally of the frame 40.

Figure 5:
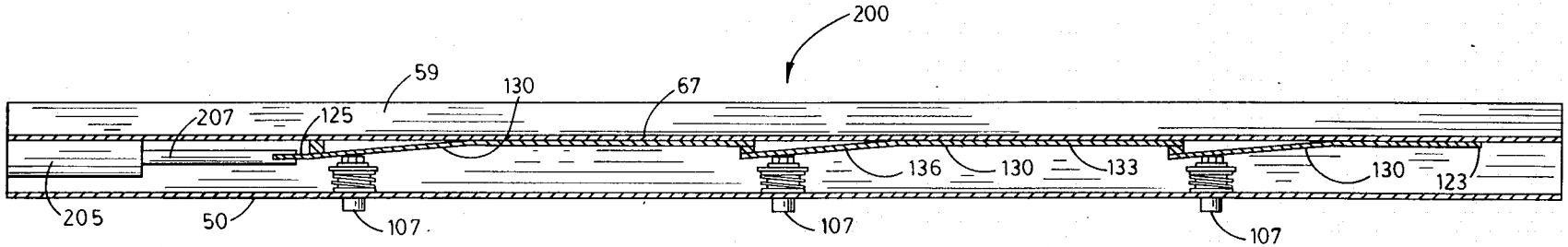
FIG. 5 is a longitudinal section of a first alternative embodiment of the apparatus of the present invention.

A first alternative embodiment of the apparatus 10 of the present invention is illustrated in FIG. 5 in longitudinal section and is designated generally by the numeral 200 therein. As shown therein, the apparatus 200 provides a frame 40 and actuating assembly 120, substantially identical to that of the apparatus 10 of the preferred embodiment. However, rather than a handle member 160, an actuating solenoid 205 is deployed internally of the channel 61 and has a reciprocating arm 207 on the actuating assembly 120 for movement of the actuating assembly 120 between the first and second positions. The solenoid 205 is depicted substantially schematically and can be actuated by any suitable electrical means (not shown) disposed externally of the frame 40.

Figure 6:
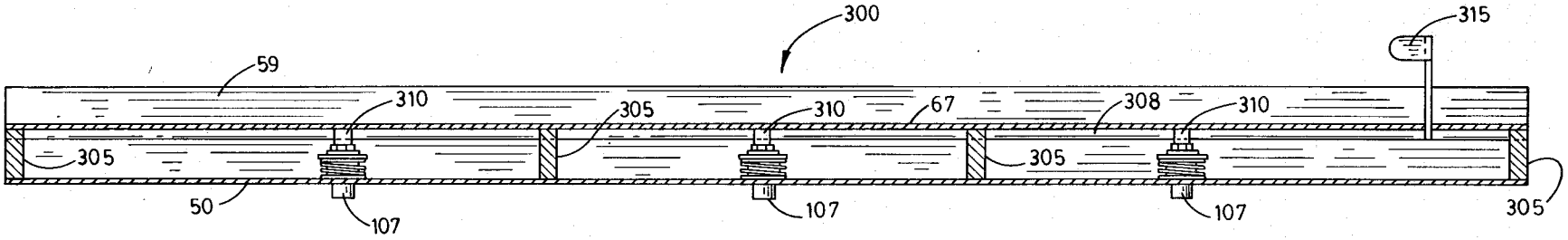
FIG. 6 is a longitudinal section showing a second alternative embodiment of the apparatus.

A second alternative form of the present invention is shown in FIG. 6 in longitudinal section and is designated generally by the numeral 300 therein. As shown therein, the apparatus 300 provides a plurality of mounting blocks 305 mounting an elongated shaft 308 for pivotal movement about a longitudinal axis extending between the opposite end portions of the frame 40. The shaft 308 provides a plurality of engagement members 310 extending transversely from the shaft and disposed for substantially simultaneous compressive engagement with the heads 98 of the bolts 95 upon rotation of the shaft 308 about its axis of rotation. A handle member 315 is rigidly secured on the shaft 308 and extends radially therefrom to permit manual rotation of the shaft 308.

Figure 7:
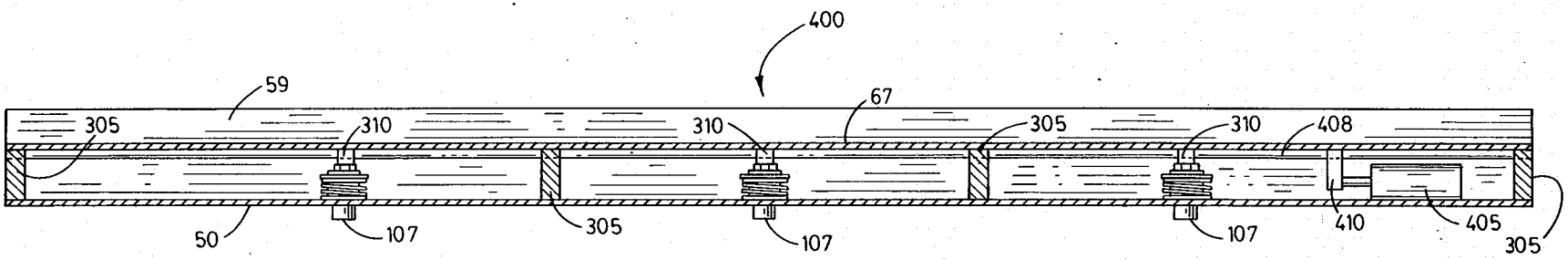
FIG. 7 is a longitudinal section showing a third alternative embodiment of the present invention.

A third alternative form of the apparatus 10 of the present invention is shown in longitudinal section in FIG. 7 and is designated by the numeral 400 therein. As shown therein, the third form 400 is substantially identical to that of the second alternative form 300, excepting that the handle member 315 is replaced by an electrical motor 405 or the like, depicted substantially schematically, having a rotary shaft 408 extending therefrom and connected to the shaft 308 by a suitable linkage 410 The motor 405 is adapted to be secured to a suitable source of electrical energy and is adapted to be operated by the actuation of a suitable triggering mechanism (not shown) disposed externally of the frame 40.

OPERATION

The operation of the described embodiments of the present invention is believed apparent and is briefly summarized at this point.

The apparatus 10 of the present invention is utilized for securing a door 15 or the like in a closed attitude, such as that depicted in FIGS. 1 through 4. To permit free pivoting of the door 15 about the hinges 27, the handle member 160 is disposed in the attitude depicted in phantom lines in FIG. 1. In such an attitude, the actuating assembly 120 is deployed in the second position wherein the second end portion 125 thereof is in engagement with the detent 79. In such position, the flat portions 133 of the actuating members 130 are disposed substantially vertically upwardly of the bolts 95. Accordingly, the springs 115 are permitted to urge the bolts 95 upwardly with the heads 98 of the bolts in engagement with the lower surfaces 143 of the corresponding actuating members 130. In such an attitude, the lower end portions 107 of each bolt 95 are retracted substantially completely internally of the guide cylinders 83.

With the door in a closed attitude, the handle member 160 is grasped and moved substantially horizontally within the slot 70 until the first end portion 123 of the actuating assembly engages the detent 77.

As the actuating assembly 120 moves toward engagement with the detent 77, the oblique portions 136 of each actuating member 130 engage the head portions 98 of the corresponding bolts 95 and progressively cause compression of the springs 115. As the bolts 95 are compressed downwardly, the lower end portions 107 will be directed downwardly into the appropriate corresponding bores 155 in the threshold 35. Thus, in a locked attitude, the door 15 is prevented from pivoting about the axes of the hinges 27.

The operation of the first alternative embodiment 200; second alternative embodiment 300; and third alternative embodiment 400 are similar to that of the preferred embodiment. In operating the first alternative embodiment 200, the solenoid is selectively actuated to move the actuating assembly 120 back-and-forth between a locked and unlocked attitude. The second alternative embodiment 300 is operated by manually or otherwise moving the handle member 315 to rotate the shaft 308 between a locked and unlocked position. The third alternative embodiment 400 is operated similarly to the second alternative embodiment 300, by actuation of the electric motor 405 to rotate the shaft 408.

The present invention is also adapted to be constructed as an integral component of a fabricated door assembly, rather than as a separate attachment for installation on an existing door. Moreover, the apparatus is adapted to be installed on or incorporated integrally into virtually any type of door or window, including those of the type which are slidable along a track. Of course, when used in combination with a sliding window or door assembly, the apparatus 10 preferably is constructed as an integral component of the assembly. For such use, appropriate bores would be provided in the track portion over which the door or window is adapted to slide, and the locking elements would be disposed for retractable insertion within the bores.

Alternatively, the need for pivoting bores in the threshold or other portion of the door or window frame can be avoided by the installation of suitable receiving elements on or in the frame having detent portions adapted to be engaged by the locking elements to prevent movement of the door relative to the frame when the locking elements are extended from the apparatus.

Accordingly, it is seen that the apparatus 10 of the present invention provides an effective and exceedingly durable means for quickly and simply securing a door or the like against unauthorized or undesired opening thereof.

Although the invention has been herein shown and described in what are conceived to be the most practical and preferred embodiments, it is recognized that departures may be made therefrom within the scope of the invention, which is not to be limited to the illustrative details disclosed.

Having described our invention, what we claim as new and desire to secure by Letters Patent is:

1. A locking apparatus comprising,

A. a housing having upper and lower portions, said upper portion defining an elongated channel dimensioned to be received about the lower edge portion of the door and said lower portion of the housing having a base mounting upright portions defining a channel therebetween and said base having a plurality of circular apertures extending therethrough;

B. a guide cylinder assembly including a guide cylinder mounted in axially upright attitude on the base within the channel between said upright portions in alignment with each of said apertures and a helical compression spring loosely fitted about each of said guide cylinders;

C. a locking element received for slidable movement within each guide cylinder, each of said locking elements having a body dimensioned for substantially close fitting slidable movement axially within its respective guide cylinder and a bolt secured on the body and extending through and securing an annular flange on the body for compressibly engaging the helical compression spring extending about the guide cylinder; and D. an actuating assembly for reciprocal slidable movement in the channel, defined by said upright portions of the lower portion of the housing, between a first position and a second position, the actuating assembly including a plurality of serial interconnected actuating members each having an oblique portion extending obliquely downwardly for engagement with an individual locking element, said actuating assembly, upon movement of the first position, causing each oblique portion to engage the bolt of each locking element to urge the body thereof to extend externally of the lower portion of the housing to a locked attitude and, upon movement to the second position, moving each oblique portion to permit each helical compression spring to urge the body of each locking element to a retracted position substantially completely internally of its respective guide cylinder in an unlocked attitude.

2. The locking apparatus of claim 1 wherein one of said upright portions of the lower portion of the housing defines a slot extending longitudinally of the housing between said upper and lower portions and the actuating assembly includes a handle mounted thereon and extending outwardly of the housing through said slot and movable longitudinally of the slot to move the actuating assembly between said first and second positions.

3. The locking apparatus of claim 2 wherein the handle has a first portion rigidly mounted on one of the actuating members and extending externally of the housing through the slot and an upwardly extending portion mounted on and extending upwardly from said first portion disposed completely externally of the housing.

4. The locking apparatus of claim 1 wherein helical compression springs exert pressure upwardly to maintain the locking elements in engagement with their respective actuating members regardless of the position in which the actuating assembly is deployed between said first and second positions.

* * * * *